US005964157A

United States Patent [19]

Hummel et al.

[11] Patent Number: 5,964,157

[45] Date of Patent: Oct. 12, 1999

[54] METHOD AND ARRANGEMENT FOR CLEANING A PART OF A PRINTING UNIT OF AN OFFSET PRINTING MACHINE

[75] Inventors: Peter Hummel, Offenbach; Robert Ortner, Alzenau, both of Germany

[73] Assignee: MAN Roland Druckmaschinen AG, Germany

[21] Appl. No.: 09/023,632

[22] Filed: Feb. 13, 1998

[30] Foreign Application Priority Data

Feb. 14, 1997 [DE] Germany ..... 197 05 632

[51] Int. Cl.[6] ..... B41C 33/00

[52] U.S. Cl. ..... 101/483; 101/424

[58] Field of Search ..... 101/483, 484, 101/424, 423, 425

[56] References Cited

U.S. PATENT DOCUMENTS

| | | | |
|---|---|---|---|
| 4,344,361 | 8/1982 | MacPhee et al. | 101/425 |
| 4,534,291 | 8/1985 | Sabota et al. | 101/483 |
| 4,967,664 | 11/1990 | Iijima | 101/423 |
| 5,031,535 | 7/1991 | Kipphan et al. | 101/483 |
| 5,109,770 | 5/1992 | Uribe et al. | 101/425 |
| 5,233,923 | 8/1993 | Fuchi | 101/425 |
| 5,450,792 | 9/1995 | Gegenheimer et al. | 101/425 |
| 5,584,245 | 12/1996 | Sachonberg | 101/484 |
| 5,753,048 | 5/1998 | Lippold et al. | 101/483 |

FOREIGN PATENT DOCUMENTS

| | | | |
|---|---|---|---|
| 0236053 | 5/1986 | Germany | 101/425 |
| 44 43 356 | 6/1996 | Germany . | |
| 44 43 357 | 6/1996 | Germany . | |
| 0022058 | 2/1982 | Japan | 101/425 |

*Primary Examiner*—Edgar Burr
*Assistant Examiner*—Anthony H. Nguyen
*Attorney, Agent, or Firm*—Leydig, Voit & Mayer, Ltd

[57] ABSTRACT

An apparatus and method is disclosed for the automatically controlled the washing of a part of a printing unit of an offset printing machine as a function of the ink consumed by the unit. The control of at least one washing device, which is assigned to one of the parts of the printing unit, is performed, in particular with respect to the washing frequency, as a function of characteristic values which are derived from functions of the printing unit and/or are generated for controlling these functions. In order to optimize the frequency of the washing operation and/or the type of washing operation, the ink consumption of the printing unit occurring during machine running is determined in accordance with at least one characteristic value of the ink metering, the frequency and/or type of washing operation is then determined from the amount of ink consumption.

6 Claims, 2 Drawing Sheets

METHOD AND ARRANGEMENT FOR CLEANING A PART OF A PRINTING UNIT OF AN OFFSET PRINTING MACHINE

TECHNICAL FIELD

The invention relates to a method for the automatically controlled washing of at least one part of a printing unit of an offset printing machine. A further aspect of the invention relates to an arrangement for carrying out such a method on a washing device, which is assigned to at least one part of a printing unit of an offset printing machine having a control desk.

BACKGROUND

A printing unit includes a blanket cylinder, an impression cylinder, an inking unit and optionally a damping unit. In the case of dry offset printing, for example, the damping unit is not necessarily a part of the printing unit.

Automatic washing devices are known for inking units, blanket cylinders and printing cylinders of a printing unit of an offset printing machine, which make rapid cleaning possible from a control desk—e.g., "Roland 700" brochure from MAN Roland Druckmaschinen AG. Using such a washing device, it is possible for a plurality of washing programs to be defined, which allow the device to adapt to different production conditions and to changes in the water and detergent. The washing operation is initiated manually from the control desk. Although this approach functions well, there remains a problem of how one of the washing programs is activated optimally or how a washing operation is to be initiated.

Furthermore, it is known to use a controlled supply of detergent for cleaning cylinders of a rotary printing machine, which ensures an approximately identical degree of moisture at the beginning of washing in the case of a washing roll or a washing cloth (DE 44 43 357, which is hereby incorporated herein by reference). To this end, the number of sheets printed since a previous washing are ascertained at the beginning of a washing operation. Depending on the number, the quantity of cleaning fluid—detergent and water—is to be supplied under control to the washing device. The number of washing operations is controlled with the same dependency. Although this approach works well, the quality of the cleaning could be improved.

In another example of an arrangement for cleaning a cylinder of a rotary printing machine, a washing device is thrown onto and off the cylinder. A washing roll or washing cloth is sprayed with the cleaning fluid. The detergent feed on the outer surface of the cylinder is controlled whilst taking into account the rotational speed and direction of rotation of the cylinder to be cleaned (DE 44 43 356). Although this approach also works well, the quality of the cleaning could be improved.

SUMMARY OF THE INVENTION

The present invention is aimed at optimizing the automatic control of the washing operation, in particular the washing frequency, from the point of view of washing quality and washing time.

According to one important aspect of the invention, the ink consumption values used in connection with the control of the consumption of the ink also determine the frequency and/or type of the washing operation. By linking the control of the washing operation to the same parameters that control the inking operation, the removal of the ink residue better complements the application of the ink. The ink consumption values that are particularly expedient to also control the washing operation include the control/feedback signals of a zonal setting of ink-metering elements, an ink stripe width and a feed roller cycle.

The method of the invention is based on the discovery that the degree of contamination of the inking and damping unit, the blanket cylinder and the impression cylinder is decisively bound up with the quantity of ink that is applied after the last washing operation. It is particularly advantageous that the ink consumption values, which are decisive for the ink consumption, are formed accurately from control/feedback signals. These signals are in any case provided during the control of the offset printing machine. That is to say, special apparatus is not needed for controlling the washing frequency and/or type of washing operation according to the invention. Moreover, the control signals for a washing device from these available control/feedback signals is accomplished without requiring complicated re-configuring of the control system. The control of the frequency and/or type of washing operation can, for example, contain a control of spraying and doctoring times on an inking unit and/or damping unit, it being also possible to control whether only rolls of the inking and damping unit are washed.

For example, in keeping with the invention a method of determining the ink consumption values of an offset printing machine as described in detail in EP 0 364 736 B1 may also be used to control the cleaning operation. In this case, the thickness of the ink film in each of the inking zones is ascertained using the settings of the metering elements, which determine the ink gap openings on an ink fountain. The zone-wide metering elements are arranged close alongside each other next to the ink fountain roll or ink ductor roll. In this situation, a constant ink stripe length is produced, which thus does not need to be registered continuously. The ink stripe width, as a further parameter for the ink consumption, depends in a known manner on the feed roller cycle with which the ink is transferred to a feed roller, which subsequently feeds the ink to an inking unit roll. These parameters and constants depend on the machine, its setting and on other preset values, such as the materials to be processed. From these parameters and constants, it is possible for the ink consumption values to be determined, from which the control of the frequency and type of washing operation proceeds according to the invention.

The frequency and/or type of washing operation may be determined empirically as a function of the ink consumption values. Thus, the ink consumption values may be used as a basis for the future control of the frequency and/or type of washing operation. Instead of employing the quantity of consumption directly as the influencing factor, other machine variables related to the quantity of consumption may be selected by analyzing individual influencing factors. From this empirical study, a model can be constructed (e.g., a look-up table), which is then used as a basis for the future control of the frequency of the washing operation as a function of the respective ink consumption values. The function relating to the frequency and/or type of washing operation to the ink consumption values may be stored as digital data in a look-up table architecture. The memory containing the digital data is referred to below as a function generator.

In practicing the invention, a control desk of the printing machine comprises a signal processing device, which has inputs for control/feedback signals of a zonal setting of ink-metering elements, an ink stripe width or a feed roller cycle and a function generator that is coupled to these inputs. The signal processing device re-formats the control/feedback signals in a conventional manner to form signals and data relating to the quantity of printing ink consumed from the said control/feedback signals. These signals/data are presented as an input to a function generator, which contains a function relating the ink consumption values to the frequency and/or type of washing operation. The function generator may expediently be a digital memory, in which data about the quantity of printing ink consumed is related to, in the manner of a list, data describing the frequency and/or type of washing operation. Signals are formed from the last-mentioned data, and are fed from an output of the function generator to a controller of the washing devices. If the printing unit comprises a plurality of washing devices, one of which in each case is assigned to the blanket cylinder, the impression cylinder, the damping unit and the inking unit, the washing devices can be activated individually or in combination by the controller, depending on the type of washing operation.

Other objects and advantages of the invention will become apparent upon reading the following detailed description and upon reference to the drawings.

Figure 1:
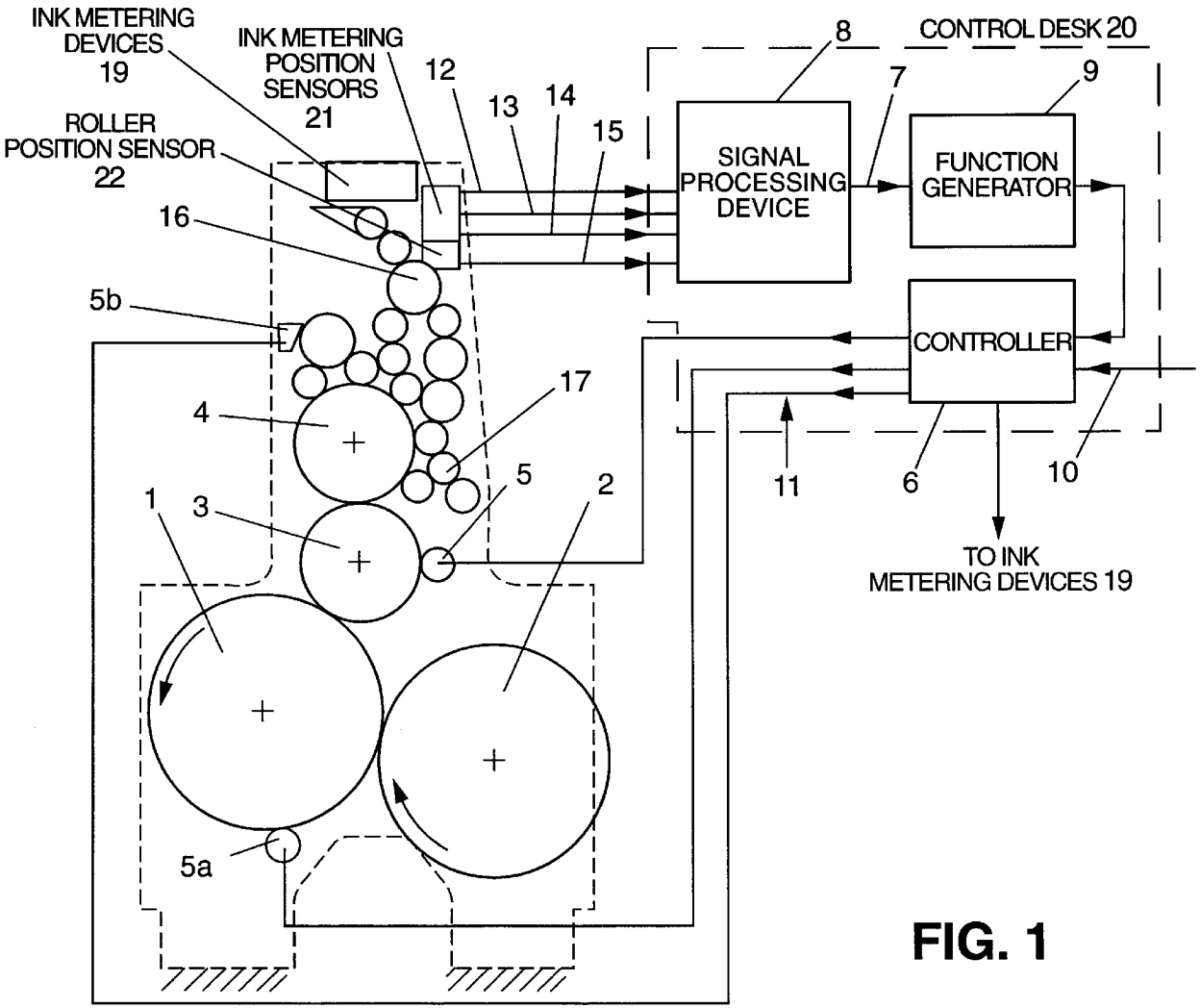
FIG. 1 illustrates a printing unit of an offset printing machine, designed as a rotary printing machine, having a control desk for control.

While the invention is susceptible to various modifications and alternative constructions, a certain illustrated embodiment has been shown in the drawings and will be described in detail below. It should be understood, however, that there is no intention to limit the invention to the specific form disclosed. To the contrary, the intention is to cover all modifications, alternative constructions and equivalents falling within the spirit and scope of the invention.

DETAILED DESCRIPTION OF THE ILLUSTRATED EMBODIMENT

Illustrated schematically in FIG. 1 is a printing unit of a multicolor rotary printing machine having an impression cylinder 1 and a transfer drum 2 preceding the latter in the sheet running direction. Adjacent to the impression cylinder 1 is a blanket cylinder 3, which is in contact with a plate cylinder 4. Connected to the plate cylinder 4 are an inking unit 16, which includes ink metering devices 19, and a damping unit 17.

The blanket cylinder 3 has a washing device 5 assigned to it. The washing device 5 essentially comprises a washing roll, for example designed as a washing brush, which is rotatably mounted in a housing. Arranged in the housing are spraying devices for the controlled feed of detergent and water, which are coupled by circuitry to a controller 6 for the washing device in a control desk 20. The washing roll is also connected to a separate drive and is in constant engagement with a doctor. The washing device 5 as a whole can be thrown onto the blanket cylinder or thrown off the latter by means of operating cylinders. The throwing on and off is also actuated by the controller 6 in the control desk 20, the washing device normally being located in the thrown off position. An example of such a washing device is described in greater detail in co-pending U.S. application Ser. No. 08/804,006 to Simeth and U.S. Pat. No. 4,270,450, which are both assigned to the same assignee as that of the present invention. Both the foregoing application and issued patent are incorporated herein by reference.

A further washing device 5*a*, which can be designed and actuated in a similar way, is assigned to the impression cylinder 1.

A washing device 5*b* is assigned to a roll of the inking unit. The design of this washing device is generally known and substantially comprises a wiper or doctor removing ink on the roll, as well as a spraying device (not illustrated) with which washing liquid can be sprayed onto one of the upper rolls of the inking unit 16. In the present embodiment of the arrangement according to the invention, the rolls of the damping unit 17 are washed with the rolls of the inking unit 16. In another embodiment, however, the damping unit 17 may instead be assigned a separate, similar washing device, which can be controlled separately from the washing device 5*b*.

The central control desk further comprises, inter alia, a signal processing device 8, from which an output is coupled to an input of a function generator 9. An output from the function generator 9 is led to an input of the controller 6 of the washing devices 5, 5*a*, 5*b*, the controller having a second conventional input 10, for example relating to the usual manual actuation of the washing devices 5, 5*a*, 5*b*. Output lines from the controller 6 are provided with the common reference symbol 11.

The inputs to the signal processing device 8 are lines 12–14, which carry signals generated by sensors 21 that resolve the positions of individual ink metering devices 19. The lines which carry the signals for adjusting the ink-metering devices are not shown. FIG. 1 further reveals a line 15 which feeds back signals to the control desk 20 from a sensor 22 associated with a feed roller (not illustrated). These signals are likewise being input into the signal processing device 8. The line 15 carries signals corresponding to the time interval during which the feed roller is resting on an ink fountain roller (not illustrated). It may additionally carry a signal which contains the rotational speed of the ink fountain roll, in order for the signal processing device 8 to calculate the ink stripe width of the ink film transferred from the ink fountain roller to the feed roller. In this case, the ink stripe length is defined by the dimensions of the ink-metering devices 21 that are arranged alongside each other, and the ink film thickness is defined by the zonal setting of these ink-metering devices. The signal processing device 8 is designed in such a way that it forms a signal or data, which correspond to the ink consumption valves. That it to say, the data contains the ink consumption values, which is provided by the incoming signals from the sensors 21 and 22 and any additional input constants and variables. To this end, the ink consumption values are calculated in accordance with known mathematical relationships such as those disclosed in U.S. Pat. No. 5,031,535, which can be realized in the signal processing device 8 by means of conventional hardware and/or software.

The signal from the output from the signal processing device 8 contains the ink consumption values, which is fed into the function generator 9. At the function generator 9, a signal is formed from the ink consumption values according to a previously stored function relating the amount of ink consumption to the frequency and/or type of washing operation. The function is derived either empirically, through trial and error, or by conventional mathematical modeling techniques which provide an analytical relationship between the ink consumption values and the frequency and/or type of washing operation necessary for the best cleaning of the printing unit. The output of the function generator 9 is fed into the controller 6 of the washing devices 5, 5*a*, 5*b*. Depending on the signal that is fed into the controller 6, the washing operation is triggered, the washing roll of the washing device 5 being thrown onto the blanket cylinder 3 in the event of activating the washing device 5. In addition, the supply of detergent and water through the spraying devices can be performed in a controlled manner. In a similar way, the washing device 5*a* on the impression cylinder 1 is activated. The activation of the washing device 5*b* on the inking and printing unit triggers appropriate spraying and doctoring operations there. These washing operations therefore proceed as a function of the ascertained consumption of printing ink, this consumption also being able to be used for other conventional purposes, for example for storing the printing ink.

Figure 2:
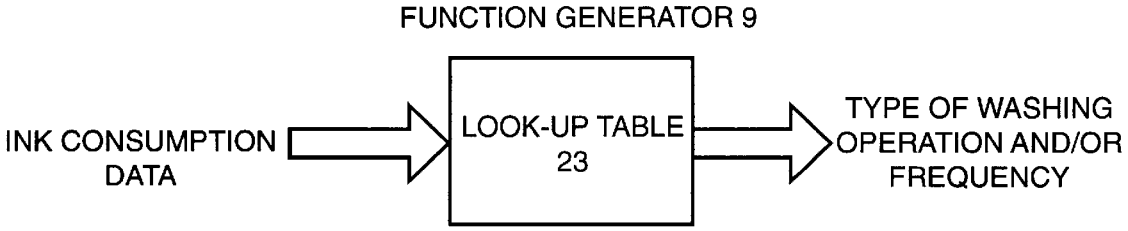
FIG. 2 is a schematic diagram of the function generator that relates the quantity of ink consumption to the type of washing operation and/or its frequency.

Turning to FIG. 2, the function generator 9 may be realized as a look-up table 23 in which values of ink consumption are related to types of washing operations and/or a frequency of the operation. The correlation provided by the look-up table 23 is established empirically so as to match the quantity of ink consumption with the type of washing operation and/or its frequency that provides the best quality washing operation.

Figure 3:
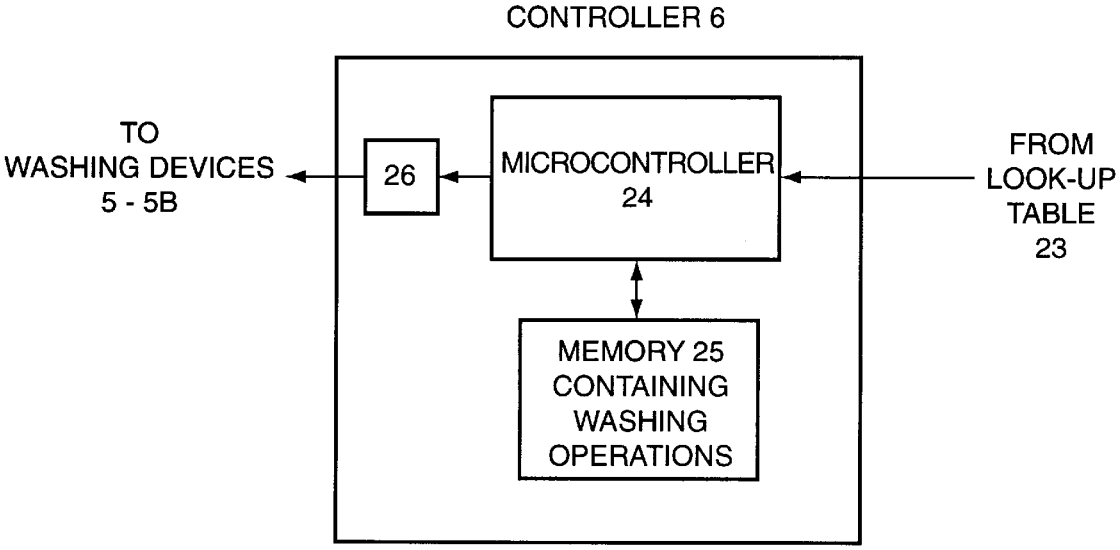
FIG. 3 is a schematic diagram of a controller that is responsive to the function generator for controlling washing devices in keeping with the invention.

The controller 6 is of a conventional architecture and includes a microcontroller 24 as illustrated in FIG. 3, which accesses a memory 25 containing the instructions for executing the several alternative washing operations identified in the look-up table 23. In response to a signal from the look-up table 23, the microcontroller 24 executes the selected one of the washing operations in accordance with the information held in the memory 25. The microcontroller 24 provides control signals to a driver 26 that converts in a conventional manner the low-power control signals from the microcontroller to drive signals for the washing devices 5–5*b*.

We claim as our invention:

1. A method for the automatically controlled washing of at least one part of a printing unit of an offset printing machine, in which the printing unit comprises a blanket cylinder, an impression cylinder, an inking unit and a washing device, the method comprising the steps of: determining an ink consumption value of the printing unit and controlling the operation of the washing device at least in part in response to the ink consumption value.

2. The method of claim 1, wherein the ink consumption value is calculated using: a setting of an ink-metering element, an ink stripe width and a feed roller rotational speed.

3. The method of claim 1, wherein the controlling is performed based on a function relating the controlling to the ink consumption values; said function being determined empirically.

4. The method of claim 1 wherein the controlling is performed based on a function relating the controlling to the ink consumption values; said function being determined by a model.

5. A printing machine comprising: a feed roller; an ink metering device; a washing device for washing the feed roller; an ink metering position sensor for sensing the position of the ink metering device at a given time; a roller position sensor for sensing the rotational speed of the feed roller; a controller for activating and engaging the washing device; a signal processing device for calculating an ink consumption value from inputs, said inputs including inputs from the ink metering position sensor and the roller position sensor; and a function generator for directing the controller to perform a specific washing operation as a function of the ink consumption value calculated by the signal processing device.

6. The printing machine of claim 5 wherein the function generator is implemented with a digital memory.

* * * * *